US005797773A

United States Patent [19]

Kobayashi

[11] Patent Number: 5,797,773

[45] Date of Patent: Aug. 25, 1998

[54] TERMINAL FITTING

[75] Inventor: Masaaki Kobayashi, Yokkaichi, Japan

[73] Assignee: Sumitomo Wiring Systems, Ltd., Japan

[21] Appl. No.: 971,045

[22] Filed: Nov. 14, 1997

Related U.S. Application Data

[63] Continuation of Ser. No. 589,352, Jan. 22, 1996, abandoned.

[30] Foreign Application Priority Data

Feb. 2, 1995 [JP] Japan ..... 7-039064

[51] Int. Cl.[6] ..... H01R 13/436

[52] U.S. Cl. ..... 439/752

[58] Field of Search ..... 439/752, 877

[56] References Cited

U.S. PATENT DOCUMENTS 4,867,712 9/1989 Kato et al. ..... 439/752

5,478,263 12/1995 Kato ..... 439/752

FOREIGN PATENT DOCUMENTS 4-23391 4/1992 Japan .

*Primary Examiner*—Gary F. Paumen

*Attorney, Agent, or Firm*—Banner & Witcoff, Ltd.

[57] ABSTRACT

When a terminal fitting 3 is inserted into a cavity 2 of a connector housing 1, stabilizers 6 formed on the terminal fitting 3 fit with a retainer 8 attached to the housing 1 in order to prevent removal of the terminal fitting 3. The portion of the stabilizer 6 that makes contact with the retainer 8 is formed into a bent member 7 that projects in an approximately perpendicular direction with respect to the direction of removal of the terminal fitting 3. By doing this, the bent member 7 has increased resistance to a load applied in the removal direction and resists damage to the retainer 8.

3 Claims, 3 Drawing Sheets

TERMINAL FITTING

This is a continuation of application Ser. No. 08/589,352, filed on Jan. 22, 1996. Now abandoned

FIELD OF INDUSTRIAL APPLICATION

The present invention relates to a terminal fitting.

BACKGROUND TO THE INVENTION

Conventionally, removal of an electrical terminal fitting that is inserted into a connector housing is prevented by doubly stopping the terminal fitting. The terminal fitting is stopped firstly by means of a lance formed in a cavity provided in the housing, and which retains the terminal fitting due to its resilience. After the terminal fitting has been stopped by the lance in this manner, it is then doubly stopped by means of a retainer that is attached to the housing. The retainer stops the terminal fitting non-elastically.

FIG. 8 of this specification shows that portion of a retainer 30 that is generally used to stop a terminal fitting 31, a so-called chin member (the boundary portion located between the connecting member of the corresponding terminal fitting and the crimped portion of the electric wire). However, the posterior edge of a stabilizer 32 is also used.

FIG. 8 shows the fitting relationship of a terminal fitting 31 with a retainer 30, from below. As is evident from the diagram, the stabilizers 32 are formed by bending in a downward direction two portions of the cut lower face of the terminal fitting 31. As a result, the stabilizers 32 are formed so as to be parallel to the direction of removal of the terminal fitting (the direction indicated by the arrow marked P in the diagram). Due to this, if a heavy load is applied to the terminal fitting 31 in the direction of removal thereof, the posterior edge of the stabilizer 32 acts as a knife-edge (see FIG. 9) and cuts and damages the retainer 30. Here, particular attention has to be paid to the fact that, since the stabilizers 32 are formed by bending away both sides of the cut lower face of the terminal fitting 31, the length of contact thereof with the retainer 30 is rather small. As a result, in the case of the small terminal fitting 31, it becomes hard to provide an effective resistance against the application of a load thereto. This results in an increased propensity for damage to occur.

The present invention has been developed after taking into consideration the above-mentioned problem in conventional terminal fittings, and aims at presenting a terminal fitting capable of supporting an increased end load.

SUMMARY OF THE INVENTION

According to the present invention there is provided a terminal fitting for insertion into an electrical connector housing, said terminal fitting having an integral upstanding portion aligned with the insertion and removal direction thereof, and having an edge adapted to engage a retaining member of the housing in use, wherein the edge extends transversely thereby to provide increased resistance to removal thereof.

The transverse extension of the edge makes it less likely that the retainer will be damaged, for example by shearing. The transverse extension can also provide an increased contact area, thereby spreading the applied load over a greater area of the retainer contact face.

The transverse extension may be constituted for example by an inward or outward bulging, or by inward or outwardly extending free ends so as to provide a 'L' shape. In the case of outward extension or outward bulging the edge may provide lateral support for a retainer in a tubular recess of the connector housing.

Most preferably two symmetrical upstanding portions are provided.

In another preferred embodiment the contact area of the upstanding portion may be greatly increased by bending one end thereof inwardly at right angles to the removal direction of the terminal. Two such portions may provide support over the whole width of the terminal.

BRIEF DESCRIPTION OF THE DRAWINGS

Other features of the invention will be apparent from the following description of several embodiments shown by way of example only in the accompanying drawings in which.

DESCRIPTION OF PREFERRED EMBODIMENTS

Figure 1:
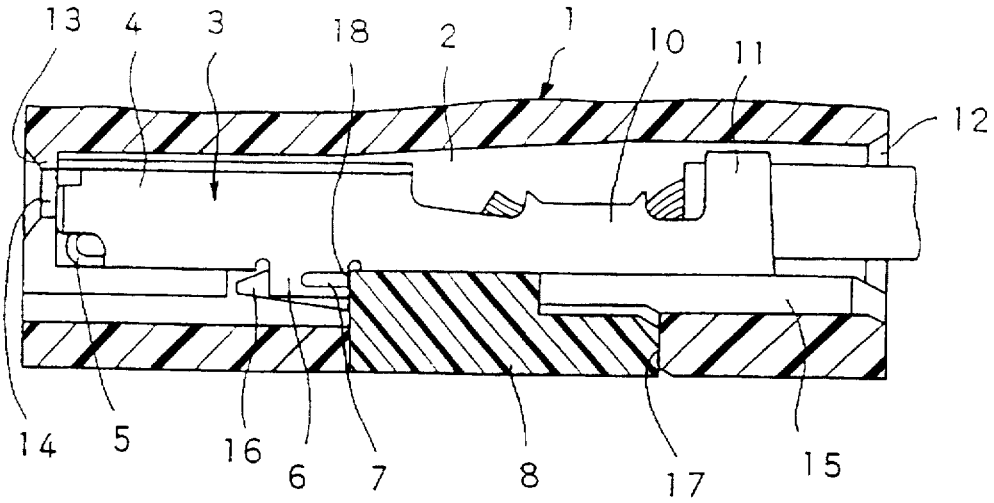
FIG. 1 is a lateral cross-section through a first embodiment.

A first embodiment of the present invention is explained hereinbelow, with reference to FIGS. 1 to 3. The diagrams show a portion of a housing 1 (moulded uniformly from synthetic resin material) of a female connector. A cavity 2 is formed in the interior of the housing 1, and a female terminal fitting 3 is inserted therein.

The female terminal fitting 3 is formed in a uniform manner from conductive metal sheet. On the anterior extremity is a connecting member 4 for forming a connection with a male terminal fitting (not shown). The connecting member 4 is bent into a rectangular tubular shape, and its upper side is overlapped as shown in FIG. 2. The connecting member 4 has a resilient contact member 5 provided on the interior thereof for connection with a male terminal fitting. The resilient contact member 5 is formed by bending over the anterior extremity of the bottom face of the connecting member 4 inwards into a U shape. The contact member 5 can change shape resiliently in an up-down direction and makes contact with the tab of a male terminal fitting due to its resilient force.

The posterior side of the lower portion of the connecting member 4 has a pair of stabilizers 6 provided on left and right sides thereof. The stabilizers 6 serve to prevent upside-down, reverse insertion of the terminal fitting 3 and to stabilize the position thereof after insertion. Both the stabilizers 6 are formed by cutting away and bending to the left and right a portion of the bottom face of the connecting member 4 so that the stabilizers 6 extend along the same plane as do the respective side faces of the connecting member 4. Furthermore, the cut-away section of the bottom face (not shown) forms a lance hole which engages with a lance 16, to be described later.

Figure 3:
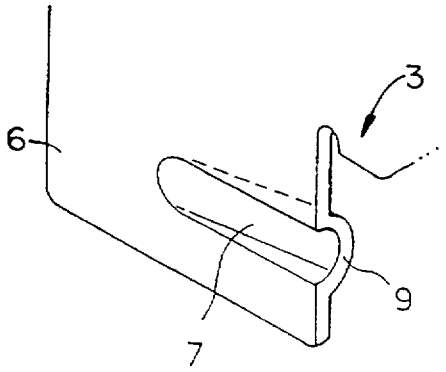
FIG. 3 is an enlarged isometric view showing bent member portions of stabilizers.

A shown in FIG. 3, the posterior end of each of the stabilizers 6 is deformed towards the inside and a strengthening bead (bent member 7) is formed thereon. The depth of the depression in the bent member 7 increases towards the posterior side, and as a result the posterior end of the bent member 7 curves in an inward direction, forming a contact edge 9 for contact with a retainer 8.

The posterior side of the connecting member 4 in the female terminal fitting 3 has a wire barrel 10 for crimping the core portion of an electric wire, and, an insulation barrel 11 is provided towards its posterior side for crimping the covered portion of the electric wire.

Figure 2:
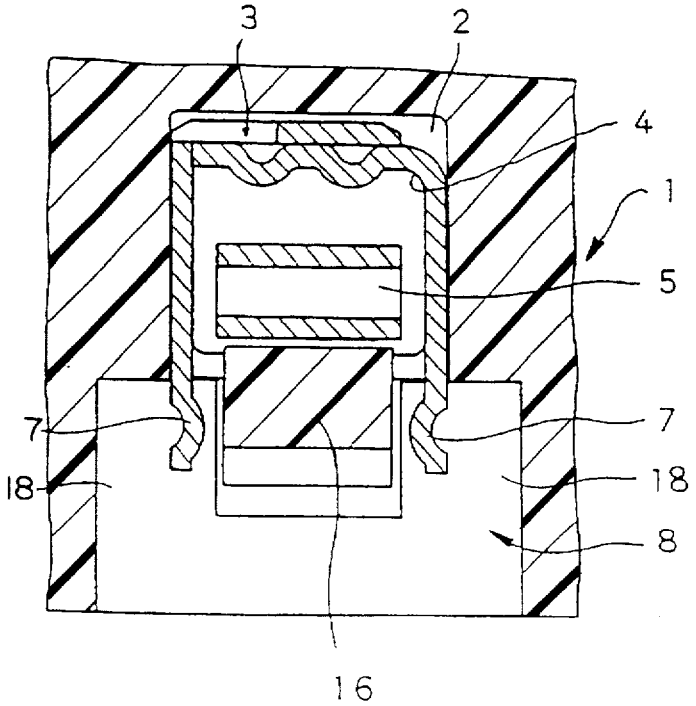
FIG. 2 is a transverse cross-section through the first embodiment.

The cavity 2 is formed so as to extend in a left-right direction with respect to FIG. 1. An insertion opening 12 for the female terminal fitting 3 is formed towards the right side of the diagram. On the left side of the cavity 2 is formed a control wall 13 that controls the extreme anterior position of the female terminal fitting 3. A connecting hole 14 for a male terminal fitting is formed co-axially to the female terminal fitting 3 on the control wall 13. Further, on the central portion of the bottom face of the cavity 2 is formed a projection 15 at a dimension that lies within a specified range from the insertion hole 12. When the terminal fitting 3 is inserted, the projection 15 makes contact with its bottom face. Since the projection 15 is provided on the central portion, the bottom face of the cavity 2 forms a convex shape when seen crosssectionally, and the left and right sides of the projection 15 serve as guiding grooves (not shown) for guiding the passage of the stabilizers 6.

The anterior extreme portion of the projection 15 has a lance 16 formed thereon for stopping the terminal fitting 3. The lance 16 projects in the direction of the connecting hole 14, and is formed so as to be resilient in the up-down direction. Since the lance 16 is flexible, a predetermined space is provided below it and which opens in the direction of the connecting hole 14 to allow the insertion of a jig in order to forcibly release the lance 16. Further, an attachment hole 17 is formed on a central portion of the lower face of the housing 1 for the insertion of the retainer 8. The attachment hole 17 is connected with the cavity 2.

Like the housing 1, the retainer 8 is also made from synthetic resin material and is attached to the housing I in a removable manner. As shown in FIG. 2, the retainer 8 is formed into a cross-sectionally concave shape so as to prevent interference between the lance 16 and the projection 15 when it is in an attached position. Further, fitting faces 18 are formed on anterior edge faces of the portions of the retainer 8 projecting to the left and right. The fitting faces 18 fit with the respective contact edges 9 of both stabilizers 6 when the female terminal fitting 3 is inserted at the correct depth. In this manner, the terminal fitting 3 as a whole is held firmly in place following the attachment of the retainer 8 since the contact edges 9 and the fitting faces 18 engage with each other.

The operation of the first embodiment is now explained in detail. First, the terminal fitting 3 is inserted into the cavity 2 from the insertion hole 12 until its anterior extremity makes contact with the control wall 13. During this operation, the terminal fitting 3 moves along the projection 15, making contact therewith all the while, both the stabilizers 6 moving along the groove portions formed along the sides of the projection 15. The terminal fitting 3 proceeds inwards, bending the lance 16 in a downward direction, and when the terminal fitting 3 is inserted up to the correct position, the lance 16 reverts to its original shape and fits into a lance hole (not shown), thereby stopping the terminal fitting 3.

After the operation described above has been carried out, the retainer 8 is attached to the housing 1 via the attachment hole 17, each of the fitting faces 18 of the retainer 8 respectively fitting with the corresponding contact edge 9 of the stabilizer 6. As a results the terminal fitting 3 is doubly stopped.

After the terminal fitting 3 has been inserted into the cavity 2 in the manner described above, there is a possibility of an external force being applied on the terminal fitting 3 in the direction of removal thereof. As a result, the fitting faces 18 apply a corresponding pushing force on the contact faces 9. As described earlier, in the conventional case, when such a pushing force is applied, grooves are cut into the fitting faces 18 relatively easily since the stabilizers 6 are formed so as to be merely parallel to the direction of removal of the terminal fitting 3. However, if, as in the first embodiment, the configuration is such that the bent member 7 is provided so that the contact edge 9 curves inwards, even if the contact length with the fitting face 18 in the vertical direction were to be the same, the contact length therewith in the horizontal direction is increased. In the case of such a configuration, the contact edge 9 cuts into the fitting face 18 in the normal direction and along the entire edge of the contact edge 9. However, the bent member interferes with this action, and to the extent that cutting into the retainer does not occur smoothly, there is resistance with respect to removal, and the formation of grooves is thereby controlled.

Moreover, apart from serving to control the formation of cut-away grooves in the fitting face 18 as described above, the bent member 7 also serves to increase the strength and rigidity of the stabilizer 6, thereby resisting unexpected changes in shape, due for example to bending forces imposed during loose transit of terminal fittings.

Figure 4:
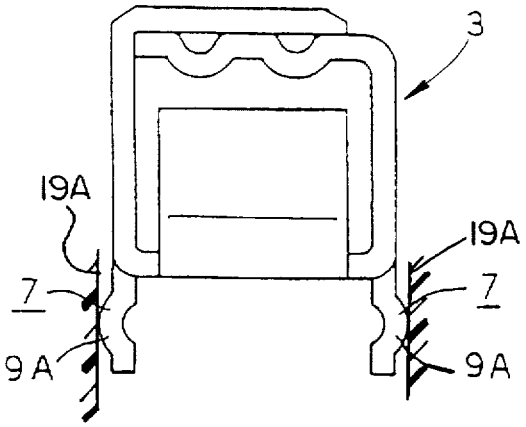
FIG. 4 is a front elevation of a second embodiment.

FIG. 4 shows a second embodiment of the present invention. In this example, a bent member 7A is formed so as to project outwards, in the direction opposite to that indicated in the first embodiment. Consequently, contact faces 9A are formed so as to curve outwards. The bulged contact faces 9A may be arranged to contact sidewalls 19A of the retainer to control lateral movement of the terminal fitting in the housing. The rest of the configuration of the second embodiment is the same as in the first embodiment and the same effect is achieved.

Figure 5:
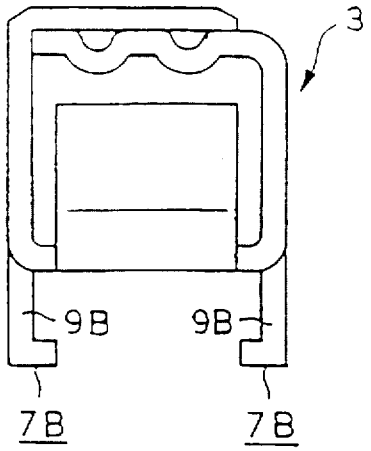
FIG. 5 is a front elevation of a third embodiment.

FIG. 5 shows a third embodiment of the present invention. In this example, bent members 7B are formed so as to bend inwards approximately at right angles along the lower extreme edges of stabilizers 6. As a result, contact edges 9B mutually face each other, each forming an L-shape. The rest of the configuration of the third embodiment is the same as in the first and second embodiments and achieves the same effect.

Figure 6:
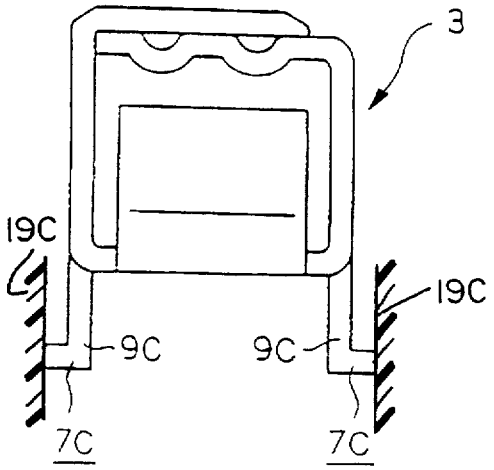
FIG. 6 is a front elevation of a fourth embodiment.

FIG. 6 shows a fourth embodiment of the present invention. In this example, bent members 7C are formed so as to bend outwards, as opposed to inwards in the third embodiment, approximately at right angles along the lower extreme edges of stabilizers 6. As a result, contact edges 9C mutually face away from each other, each forming an L-shape.

Here, the contact edges 9C project outwards and since the spaces between the wall faces 19C of the cavity 2 are filled, this configuration contributes to controlling sideways play in the housing thereby stabilizing the position of the terminal fitting. Furthermore, the second embodiment is the same in this respect.

Figure 7:
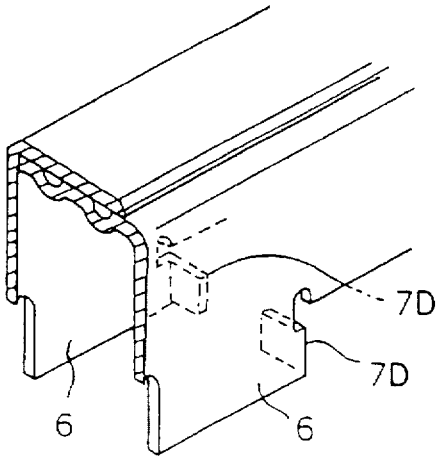
FIG. 7 is an isometric view of a fifth embodiment.
Figure 8:
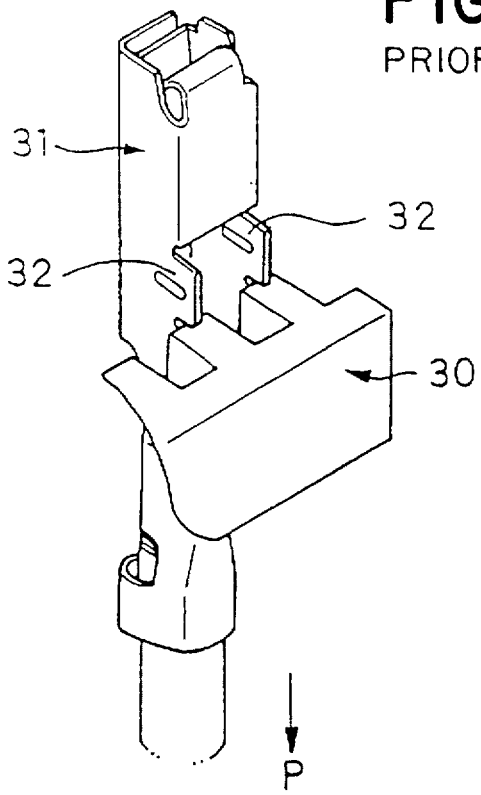
FIG. 8 PRIOR ART
FIG. 8 is an isometric view of a prior art terminal fitting.
Figure 9:
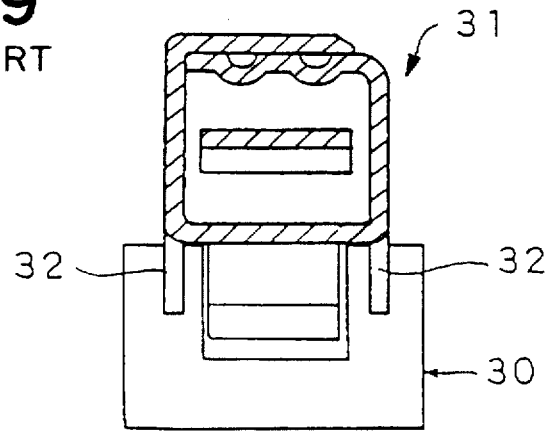
FIG. 9 PRIOR ART
FIG. 9 is a transverse cross-section through a prior art terminal fitting and a retainer.

FIG. 7 shows a fifth embodiment of the present invention. In this example, extending members are provided on posterior extremities of both stabilizers 6, and these are bent inwards to form bent members 7D. Once this is done, it becomes possible to make these fit face to face with fitting faces 18 of a retainer 8. In this respect, the fifth embodiment differs from all the earlier embodiments by significantly increasing the contact area with the fitting faces 18. The rest of the configuration is the same as in foregoing embodiments and achieves the same effect.

It is possible to modify the invention in various ways. The variations such as those described below also lie within the technical range of the present invention.

(1) Although all the embodiments apply to the female terminal fitting 3, the present invention can also apply to male terminal fittings.

(2) It is equally possible to provide the stabilizer 6 on one side only.

(3) The entire extremity of the stabilizer 6 may be arranged to be bent over firmly inwards (or outwards). In such a case as well, the formation of cut-away grooves is controlled by increasing the contact area with the fitting faces 18 of the retainer.

I claim:

1. A terminal fitting for insertion into an electrical connector housing, said terminal fitting having a connecting member adapted to mate with a corresponding connecting member of another terminal fitting to make an electrical connection therewith, said connecting member having a distal end and a longitudinal axis, said terminal fitting further having a wire contacting portion and an integral upstanding portion having an upstanding edge extending in a direction transverse to said longitudinal direction and facing away from the distal end of said connecting member, said upstanding edge being adapted to engage a retaining member of the housing in use to doubly lock the terminal fitting within the housing, wherein the upstanding portion includes an elongate strengthening bead which is generally parallel to said longitudinal axis and extends to said upstanding edge, said strengthening bead bulging inward so that a portion of the upstanding edge extends transversely out of a plane defined by the upstanding portion to provide increased resistance to damaging the retainer and removing the terminal fitting from the housing on account of a rearwardly directed axial force.

2. A fitting according to claim 1 and having two symmetrical upstanding portions, one each at either side thereof.

3. A fitting according to claim 1 in combination with a connector housing, and a retaining member engageable in the housing and with said upstanding portion.

* * * * *